US010238268B2

(12) United States Patent
Nurlybekov

(10) Patent No.: US 10,238,268 B2
(45) Date of Patent: Mar. 26, 2019

(54) SHOE DRYER

(71) Applicant: Kairat Nurlybekov, Astana (KZ)

(72) Inventor: Kairat Nurlybekov, Astana (KZ)

( * ) Notice: Subject to any disclaimer, the term of this patent is extended or adjusted under 35 U.S.C. 154(b) by 317 days.

(21) Appl. No.: 15/283,453

(22) Filed: Oct. 3, 2016

(65) Prior Publication Data

US 2018/0078113 A1 Mar. 22, 2018

(30) Foreign Application Priority Data

Sep. 20, 2016 (KZ) ..... 2016/0831

(51) Int. Cl.
*A47L 23/20* (2006.01)

(52) U.S. Cl.
CPC ..... *A47L 23/205* (2013.01)

(58) Field of Classification Search
CPC ..... A47L 23/204; F26B 21/006; F26B 9/003; F26B 21/008; D06F 59/04
USPC ..... 34/104
See application file for complete search history.

(56) References Cited

U.S. PATENT DOCUMENTS 2,267,158 A * 12/1941 Locke ..... A47L 23/205 297/188.08
3,513,564 A * 5/1970 Gramprie ..... A47K 10/06 34/104
4,677,764 A * 7/1987 Cerny ..... F26B 9/10 34/195
5,157,850 A * 10/1992 Terng-Shuh ..... F26B 9/003 34/202
5,369,892 A * 12/1994 Dhaemers ..... D06F 58/10 34/224
5,546,678 A * 8/1996 Dhaemers ..... D06F 58/10 34/224
5,666,743 A * 9/1997 Dawson ..... A47L 23/205 34/202
5,755,040 A * 5/1998 Ou ..... A47L 23/205 34/202
5,894,680 A * 4/1999 Dalvy ..... A43B 7/28 34/104
6,145,216 A * 11/2000 Bauer ..... F26B 9/003 34/105

(Continued)

FOREIGN PATENT DOCUMENTS

FR 2544190 A1 * 10/1984 ..... A47L 23/205
GB 2110918 A * 6/1983 ..... A47L 23/205

*Primary Examiner* — Stephen M Gravini
(74) *Attorney, Agent, or Firm* — Bardmesser Law Group

(57) ABSTRACT

A shoe dryer includes a working surface for drying shoes, with holes in communication with air venting means, and is characterized in that the dryer further comprises a hollow plastic case with hemispherical recesses provided for placing shoes while stepping onto the working surface, which is a latticed platform. Hot or warm air is vented from the bottom of the device onto the soles of the shoes through the lattice, and horizontal slits are provided over the entire bottom part of the hemispherical recesses for venting warm air onto the outer surface of the shoes. A tray for collecting meltwater under the platform. The meltwater is discharged either into the sewer system or outside, and the dryer further comprising means of heating the air vented from the outside, means of pumping the heated air into the case, and motion sensors which are able to detect shoes stepping onto the platform.

14 Claims, 15 Drawing Sheets

(56) References Cited

U.S. PATENT DOCUMENTS

| | | | | |
|---|---|---|---|---|
| 7,121,017 | B2 * | 10/2006 | DuRapau | A47L 23/205 34/381 |
| 7,188,435 | B2 * | 3/2007 | Woolston | F26B 9/003 34/104 |
| D575,966 | S * | 9/2008 | Hopkins | D3/313 |
| 7,430,816 | B1 * | 10/2008 | Lozenski | A47L 23/205 34/104 |
| 7,941,936 | B2 * | 5/2011 | Mangano | D06F 58/14 206/287 |
| 8,186,075 | B2 * | 5/2012 | Beckett | A47L 23/205 34/106 |
| 8,955,233 | B2 * | 2/2015 | Dean | F26B 5/12 211/205 |
| 8,955,234 | B2 * | 2/2015 | Williams | F26B 23/04 211/85.7 |
| 9,464,843 | B2 * | 10/2016 | Karafinka | F26B 9/003 |
| 2014/0331513 | A1 * | 11/2014 | Nguyen | A43D 117/00 34/275 |
| 2018/0078113 | A1 * | 3/2018 | Nurlybekov | A47L 23/205 |

* cited by examiner

SHOE DRYER

CROSS REFERENCE TO RELATED APPLICATIONS

This application claims priority to Kazakhstan Patent Application No. 2016/0831.1, filed on Sep. 20, 2016, incorporated herein by reference in its entirety.

BACKGROUND OF THE INVENTION

Field of the Invention

The invention relates to shoe drying devices and is to be used for general services.

Description of the Related Art

A conventional shoe dryer (see RU 2284742 published on Oct. 10, 2006) comprises a small-size electrically driven air pump inside a hollow case, which is a flat box with rounded corners and fixture openings, wherein the box is placed inside the shoes in order to dry them, further comprising a power supply with an electric cord and a working position stabilizer fastened to the box. The stabilizer has an open three-dimensional structure in the form of a sphere made of two wire rings installed into two opposite fixture openings.

Another conventional wet shoe dryer (see RU 2226979 published on Apr. 20, 2004) comprises an insulated handle with tips of a heater inside equipped with electrical leads connected to a power supply cord, the heater further comprising a resistive element insulated with a dielectric material and enclosed in a water-proof case. The heater has the form of an arc and is made of a flexible frame with the resistive element coiled around it, where the water-proof case is made of a flexible insulating material.

This dryer operates as follows: it is taken by the handle and placed inside the shoes, where the plastic case heats the fringe parts of the shoes closest to the heater, while the air circulating both inside and outside the shoes dries all the other parts.

Yet another conventional shoe drier (see RU 2511855 published on Apr. 10, 2014), which provides the closest technical solution, is based on a domestic linen dryer and comprises an outer cover with an upper working surface having at least one perforated drying surface in communication with air venting means. This drier is a stand with its upper part perforated, which is capable of supporting at least one shoe and of pumping air inside the supported shoe.

All conventional solutions described above are subject to a problem that they are designed to dry shoes only from the inside and cannot be used to dry and clean the outer surface of the shoes.

SUMMARY OF THE INVENTION

Accordingly, the present invention is directed to a shoe dryer that substantially obviates one or more of the disadvantages of the related art.

The objective of the present invention is to provide a shoe dryer for drying the soles and outer surface of the shoes. The dryer is to be placed, in particular at the entrances (halls, passageways, etc.) of public buildings, institutions, etc., in order to keep the floors of the buildings clean, thus saving water by reducing the cleaning, as well as to improve safety of walking on marble and tiled floors by drying shoes and removing water and icing from their soles.

An exemplary shoe dryer includes a hollow case with hemispherical recesses provided for placing shoes while stepping onto a latticed platform wherein hot air is vented onto the soles of the shoes through the lattice cells, and horizontal slits provided over the entire bottom part of the hemispherical recesses for venting warm air onto the outer surface of the shoes, and a tray for collecting meltwater provided under the platform wherein the meltwater is discharged outside via a hose.

The dryer of the present invention can be placed at the entrances of buildings and other places to dry shoes and remove water, snow and ice from their soles by venting hot and warm air on them. As a result, the shoes become dry, clean and free from remains of ice and sleet.

The shoe dryer comprises a working surface for drying shoes, equipped with holes in communication with air venting means, and is characterized in that the dryer further comprises a hollow plastic case with hemispherical recesses provided for placing shoes while stepping onto the working surface, which is a latticed platform wherein hot or warm air is vented from the bottom of the device onto the soles of the shoes through the lattice cells, and horizontal slits provided over the entire bottom part of the hemispherical recesses for venting warm air onto the outer surface of the shoes, and a tray for collecting meltwater provided under the platform, in the bottom part of the device wherein the meltwater is discharged either into the sewer system or outside, and the dryer further comprising means of heating the air vented from the outside, means of pumping the heated air into the case, and motion sensors which are able to detect shoes stepping onto the platform.

The present device is to be either placed on the floor, or installed into the flooring surface.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
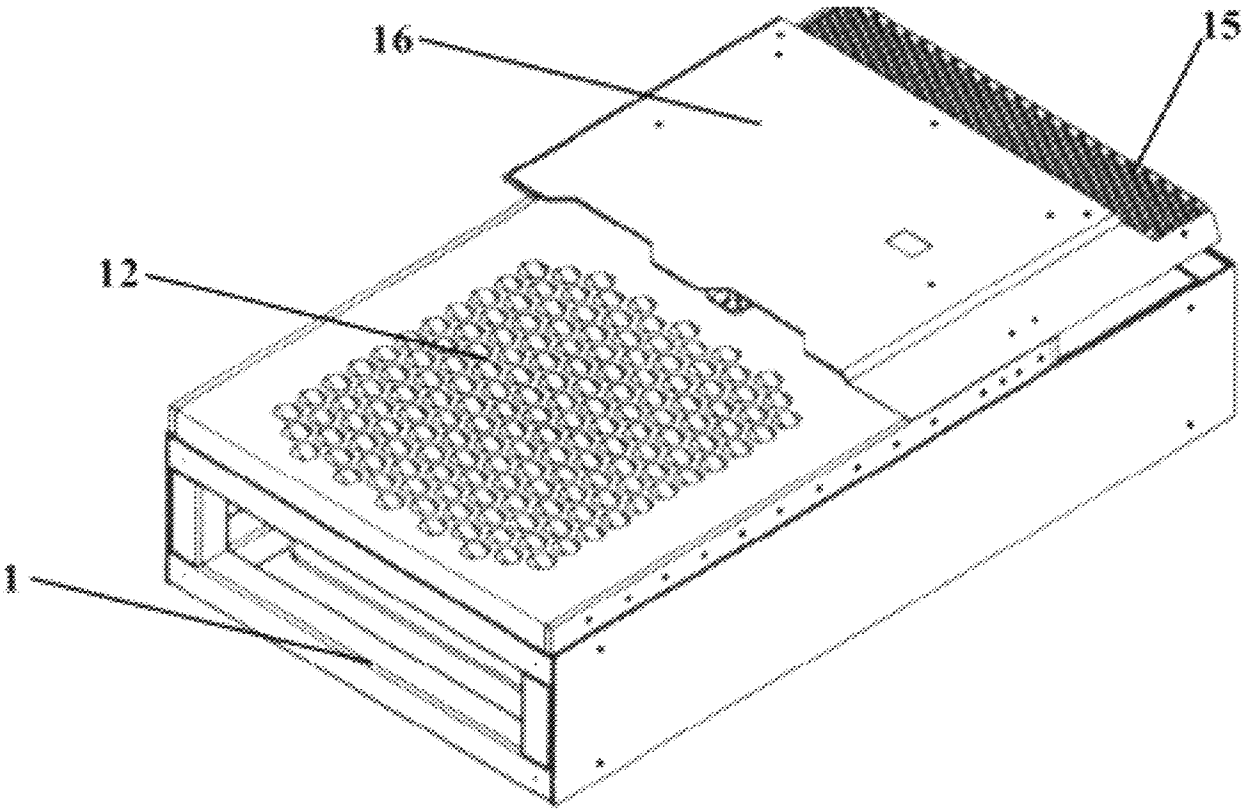
FIG. 1 shows a general view of the shoe dryer.

Reference will now be made in detail to the preferred embodiments of the present invention, examples of which are illustrated in the accompanying drawings.

The invention relates to shoe drying devices and is to be used for general services.

The objective of the present invention is to provide a shoe dryer for drying the soles and outer surface of the shoes to be placed, in particular at the entrances (halls, passageways, etc.) of public buildings, institutions, etc., in order to keep the places clean, thus saving water by reducing the cleaning, as well as to improve safety of walking on marble and tiled floors by drying shoes and removing water and icing from their soles.

The present invention is placed at the entrances of buildings and other places to dry shoes and remove water, snow and ice from their soles by venting hot and warm air on them. As a result, the shoes become dry, clean and free from remains of ice and sleet, unlike now and before.

The present shoe dryer operates as follows.

A person wearing shoes steps onto the latticed platform placing their feet into the recess, thus triggering the motion sensors which are able to detect shoes stepping onto the platform. Then, heated air is vented through the slit onto the outer surface of the shoes and also through the lattice cells of the platform onto the soles of the shoes. Drops of meltwater are then collected in the tray.

To achieve the objectives of the invention, the shoe dryer of the present invention comprising a working surface for drying shoes, equipped with holes in communication with air venting means, further comprises a hollow metallic body provided with at least two axle supports in the upper portion, the supports being joined with at least two holders by swivels;

a fan placed in a gap between two plates, inside the hollow metallic body;

a heater placed inside the hollow metallic body immediately before the fan;

an airflow nozzle attached to the plate that holds the fan and directed at a latticed plate for shoes;

a latticed plate for shoes placed above a meltwater discharge body;

a meltwater discharge body placed on the holders in the upper portion of the metallic body;

a tray for meltwater collection placed under the meltwater discharge body inside the hollow metallic body;

an air trap placed in the butt end of the metallic body between the two axle supports.

The hollow metallic body is of rectangular shape and is made of stiffeners, preferably of square section, aligned against each other.

The axle supports are of triangular shape and are joined with holders by swivels with a tilt angle of up to 110°.

The holders are made in the form of slightly bent metallic strips, while the fan is equipped with a chip placed on a plate in the upper portion of the fan; the heater is made in the form of a spiral; the airflow nozzle is further equipped with a motion sensor that is activated by the presence of shoes on the latticed plate; the meltwater discharge body is tilted towards the tray for meltwater collection; the tray is of square shape; and the air trap is placed between two axle supports.

The shoe dryer is further provided with a front cover.

The claimed invention is to be either placed on the floor, or embedded into it.

FIG. 1 shows a general view of the shoe dryer.

Figure 2:
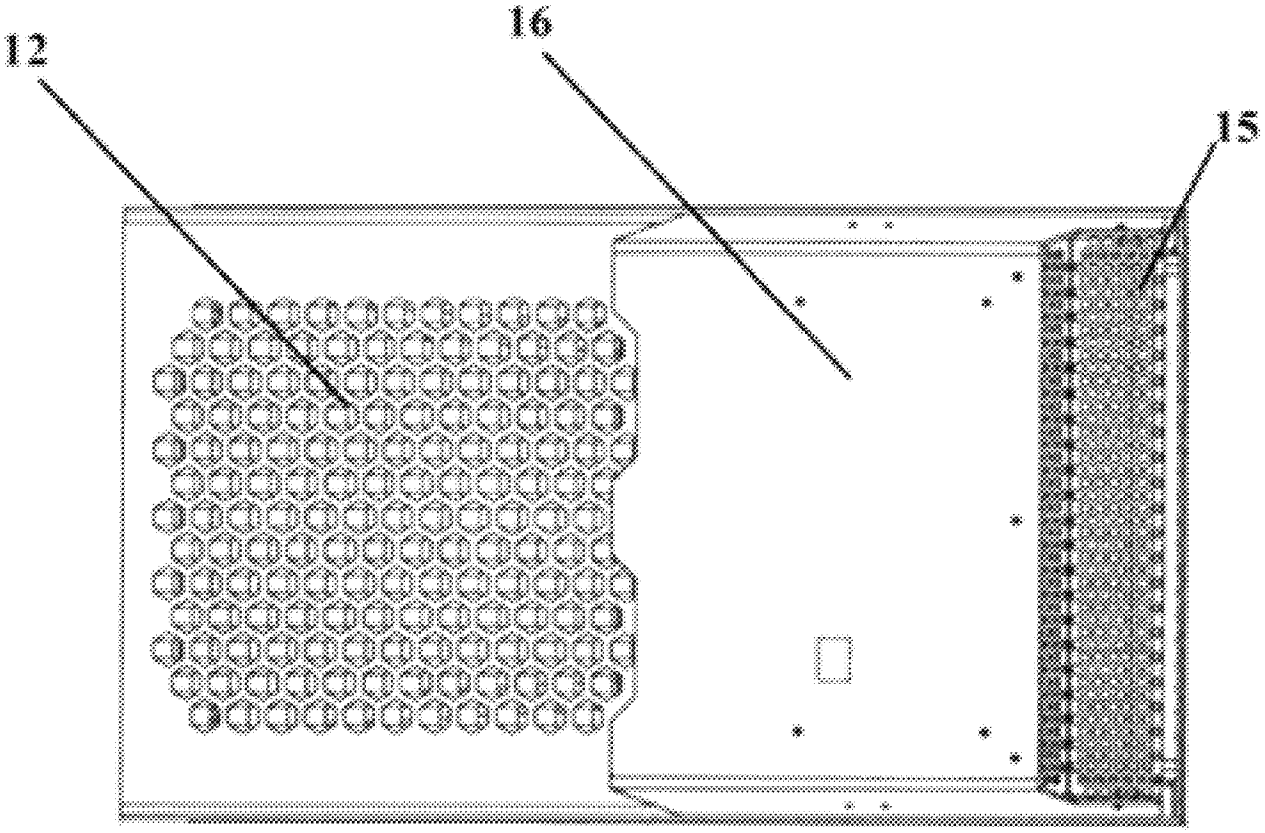
FIG. 2 shows a top view of the shoe dryer.

FIG. 2 shows a top view of the shoe dryer.

Figure 3:
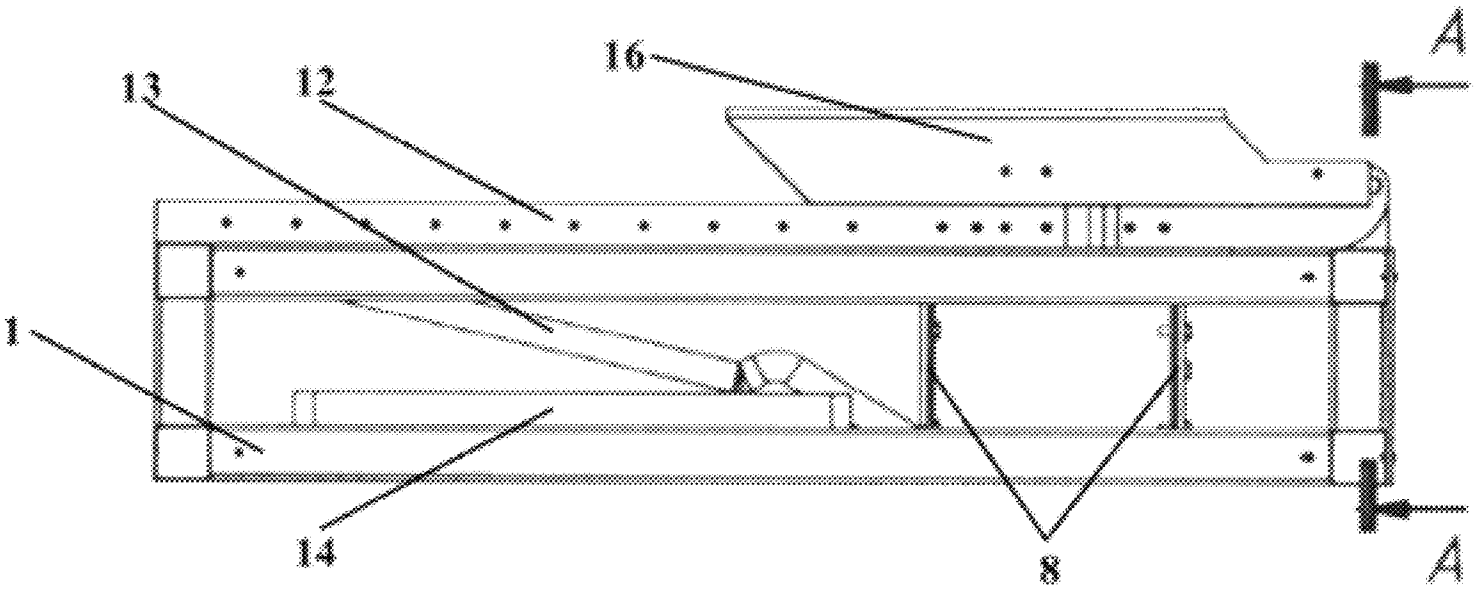
FIG. 3 shows the shoe dryer (side view; closed).

FIG. 3 shows the shoe dryer (side view; closed).

Figure 4:
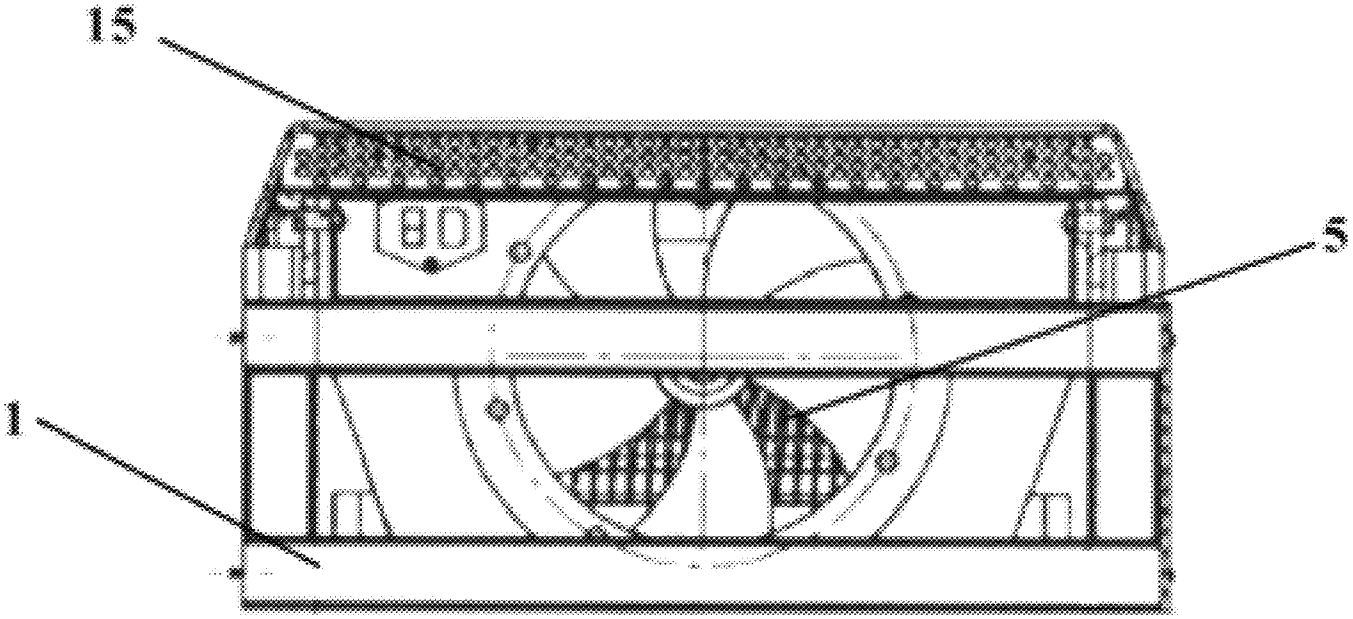
FIG. 4 shows the shoe dryer across the A-A cross-section.

FIG. 4 shows the shoe dryer across the A-A cross-section.

Figure 5:
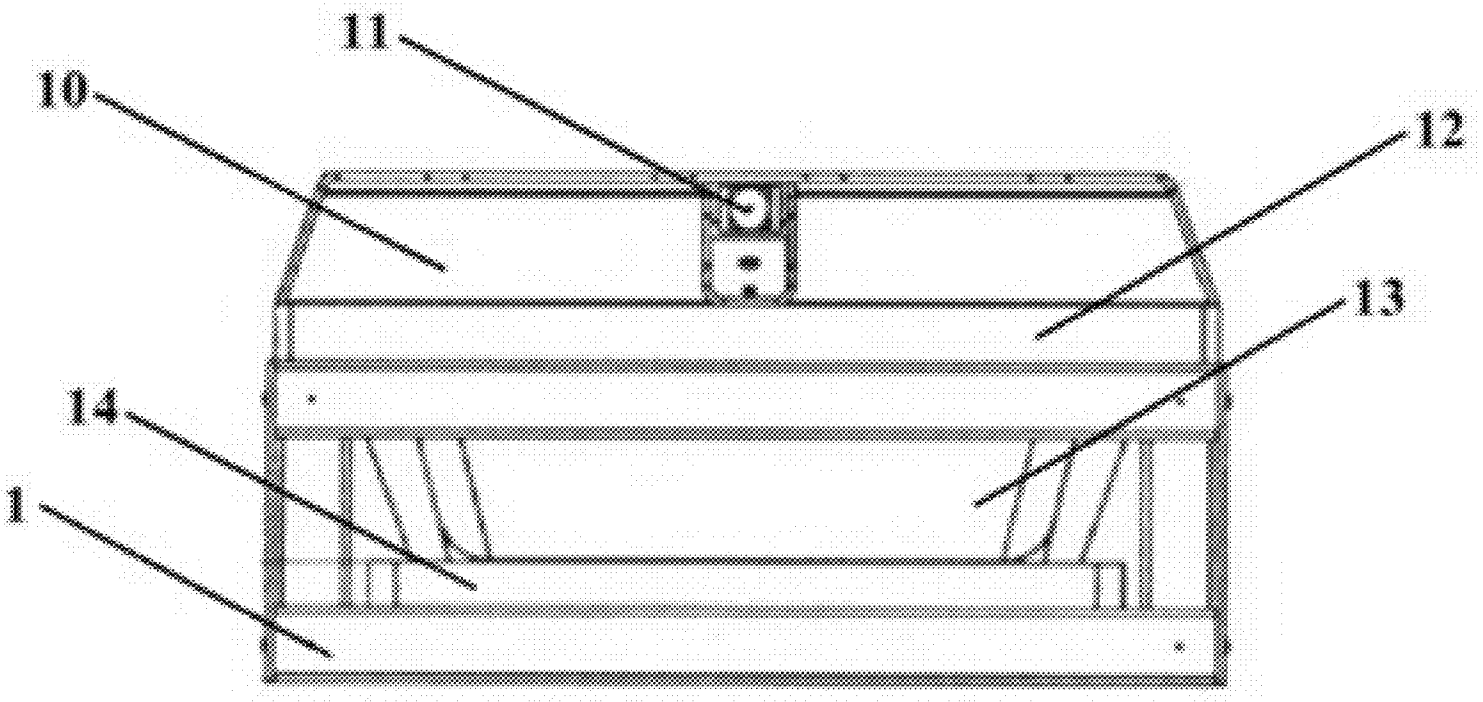
FIG. 5 shows a front view of the shoe dryer (front view).

FIG. 5 shows a front view of the shoe dryer (front view).

Figure 6:
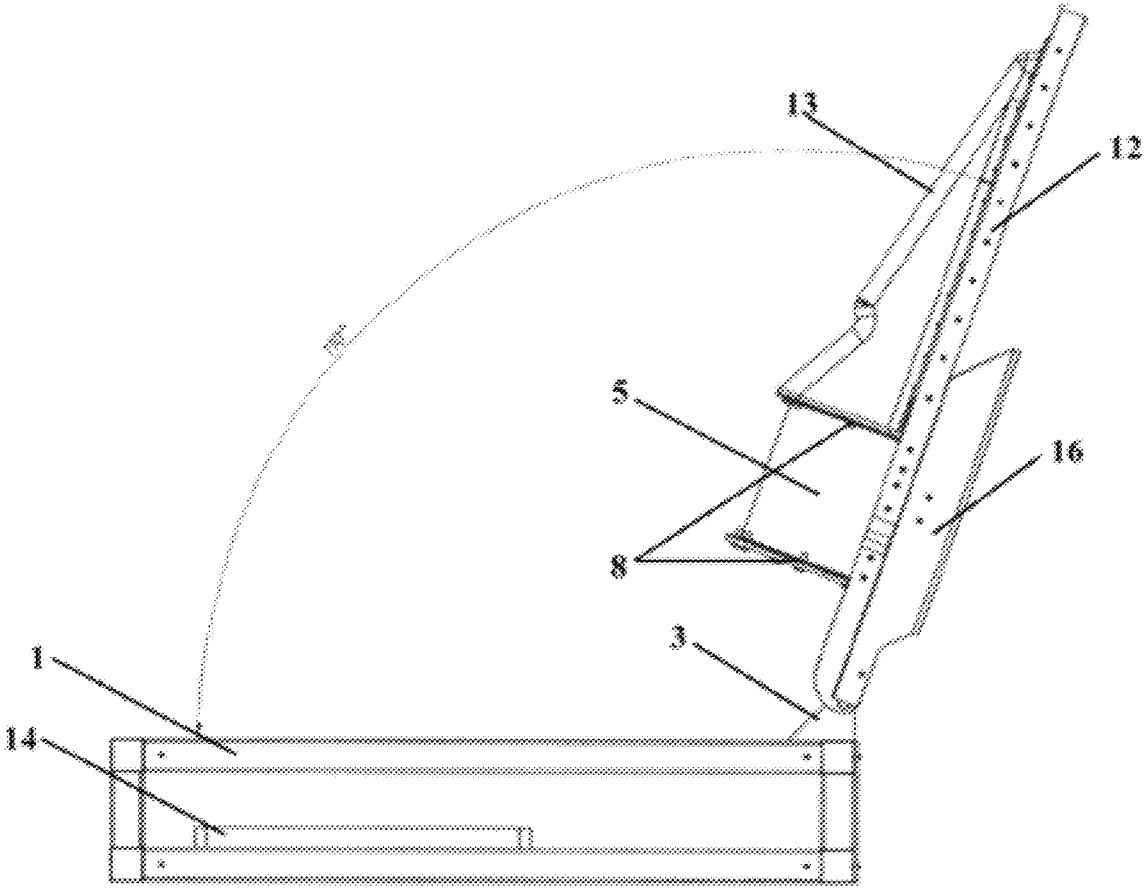
FIG. 6 shows an open side view of the shoe dryer.
Figure 7:
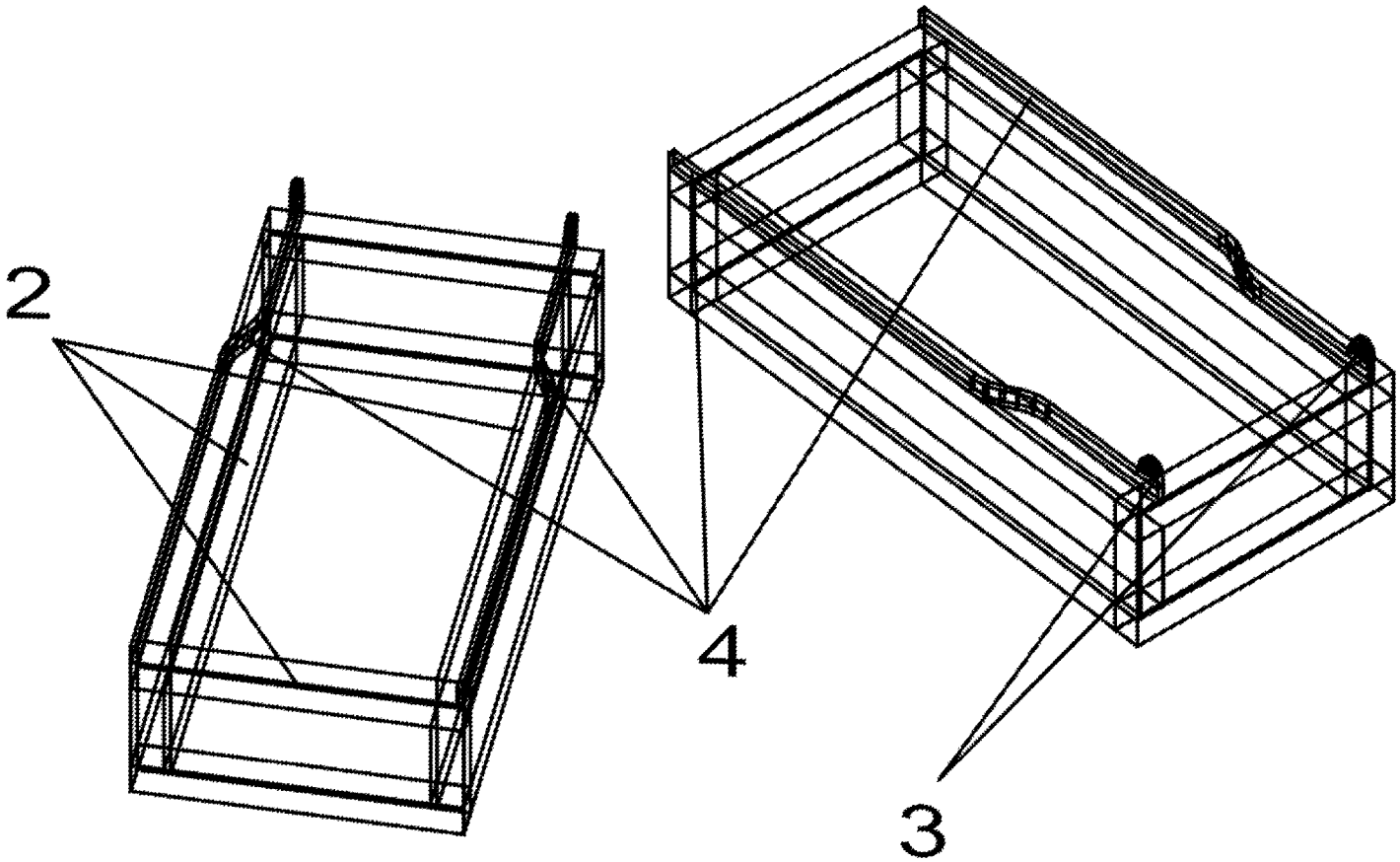
FIGS. 7-15 show isometric views of the shoe dryer as a 3D model, with the main elements added step by step going through the figures.
Figure 8:
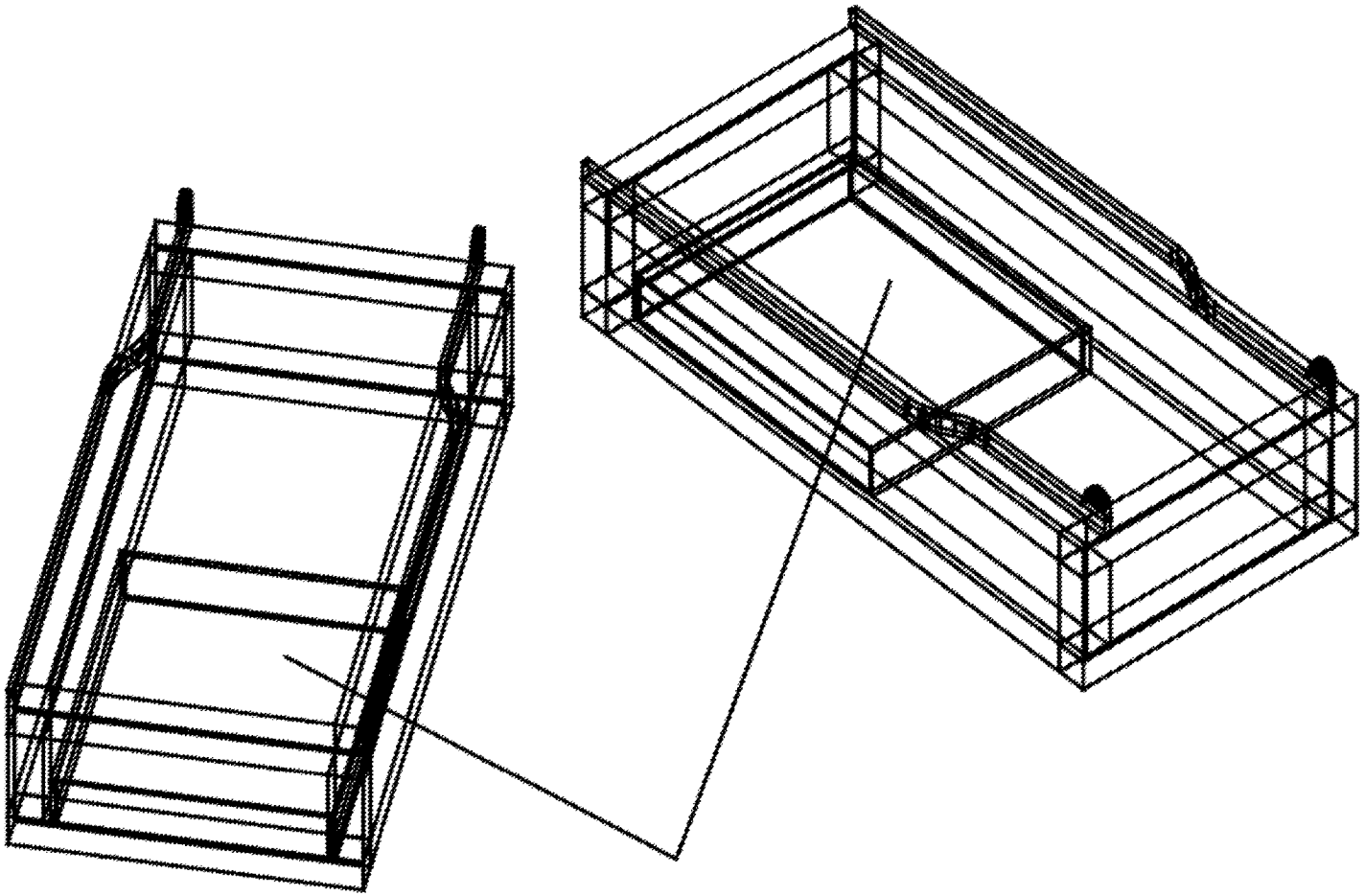
Figure 9:
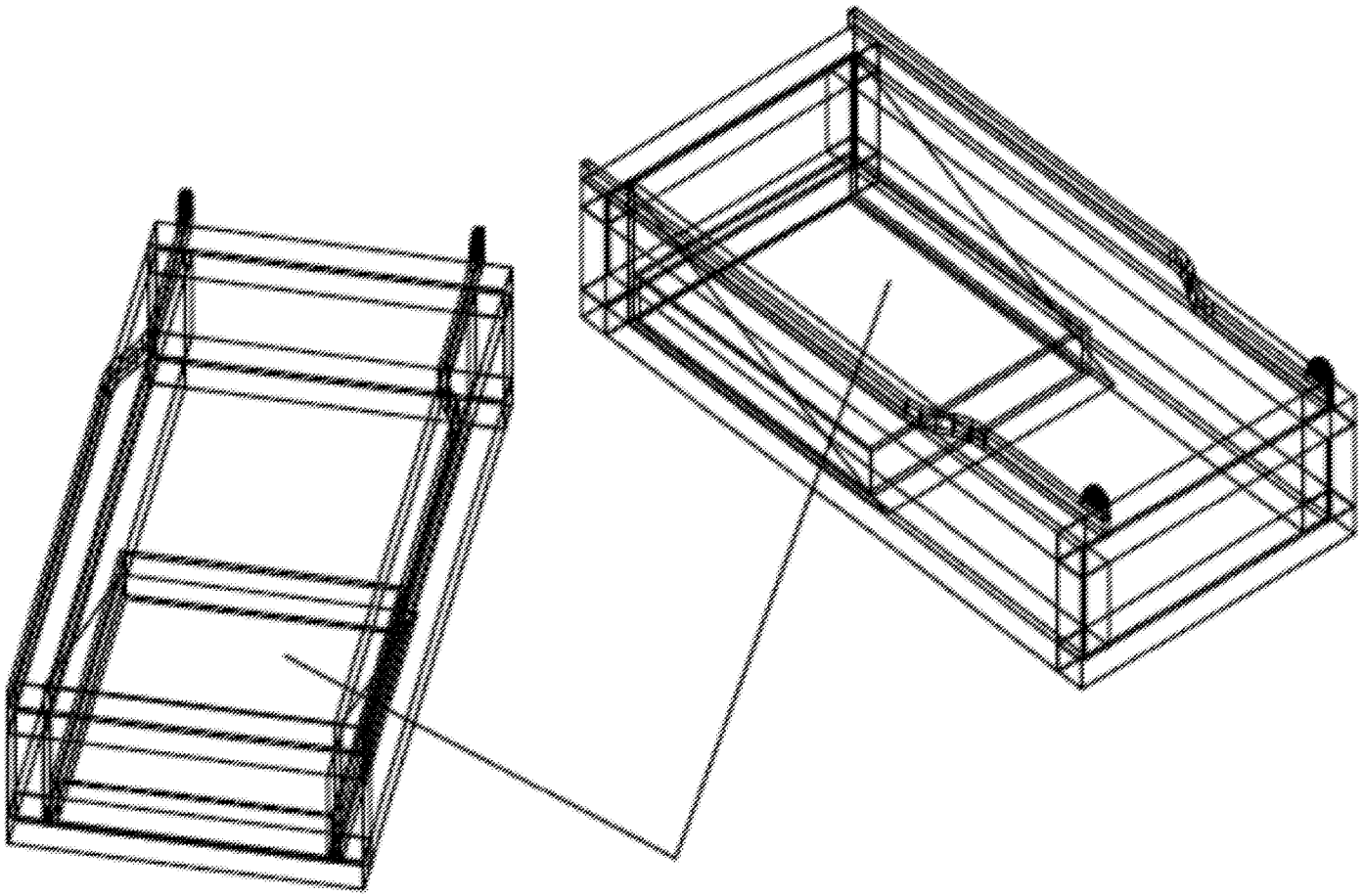
Figure 10:
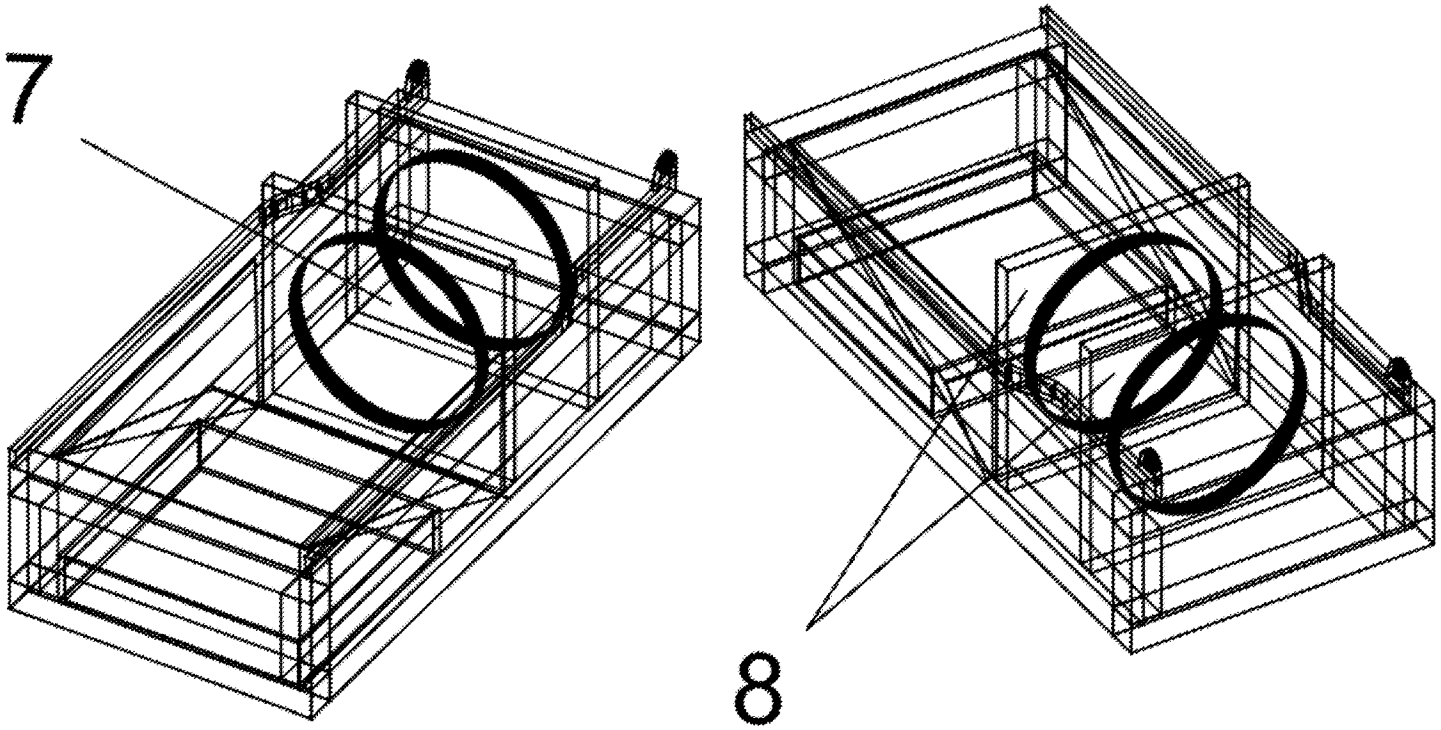
Figure 11:
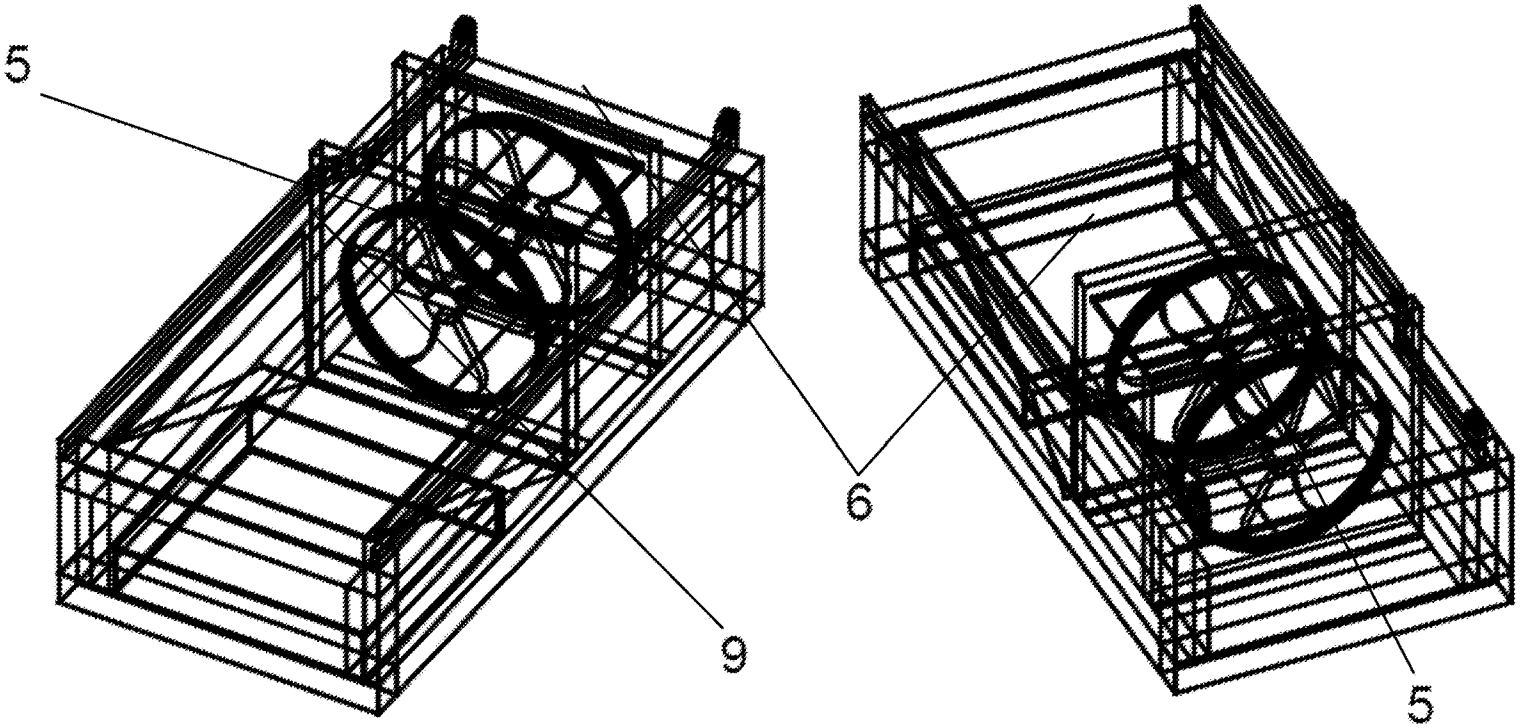
Figure 12:
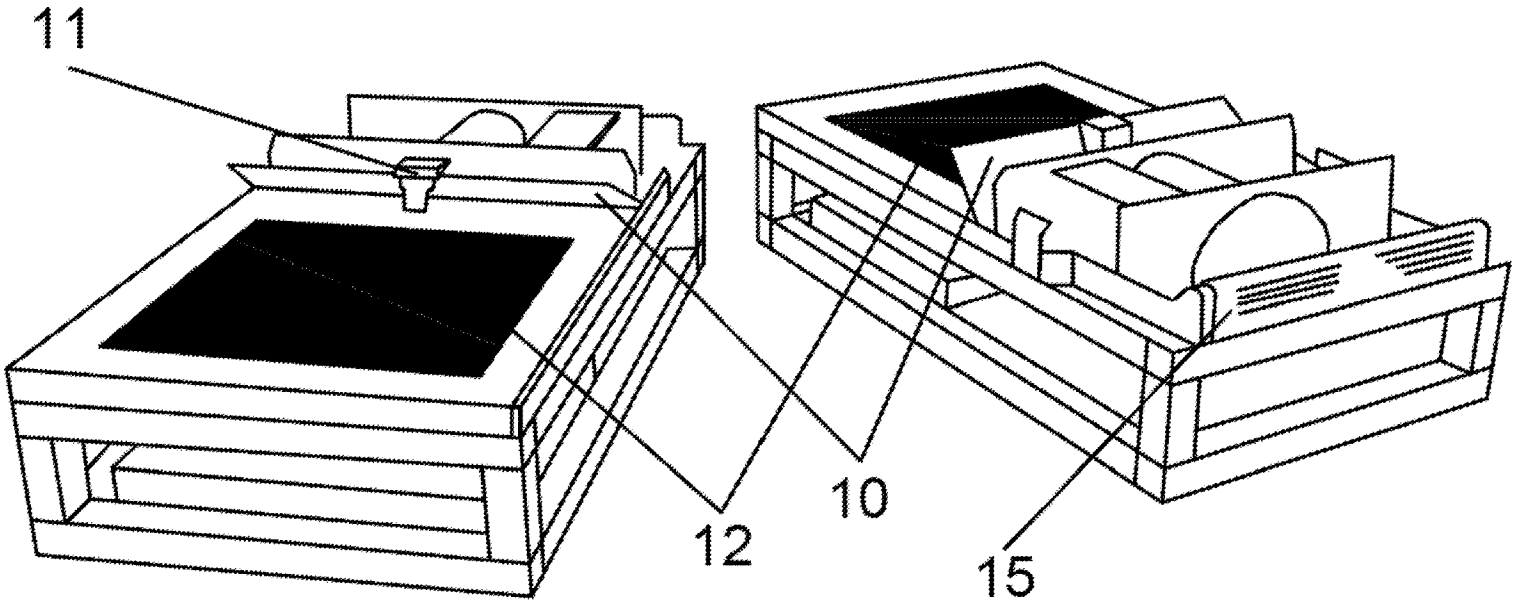
Figure 13:
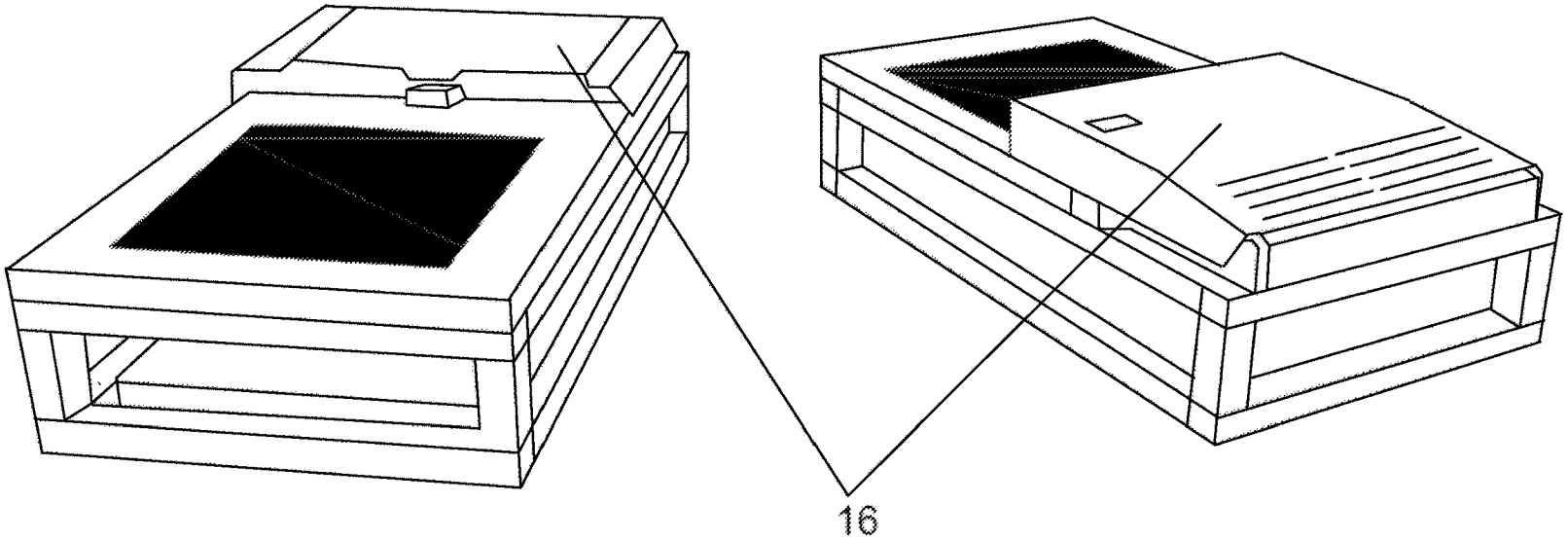
Figure 14:
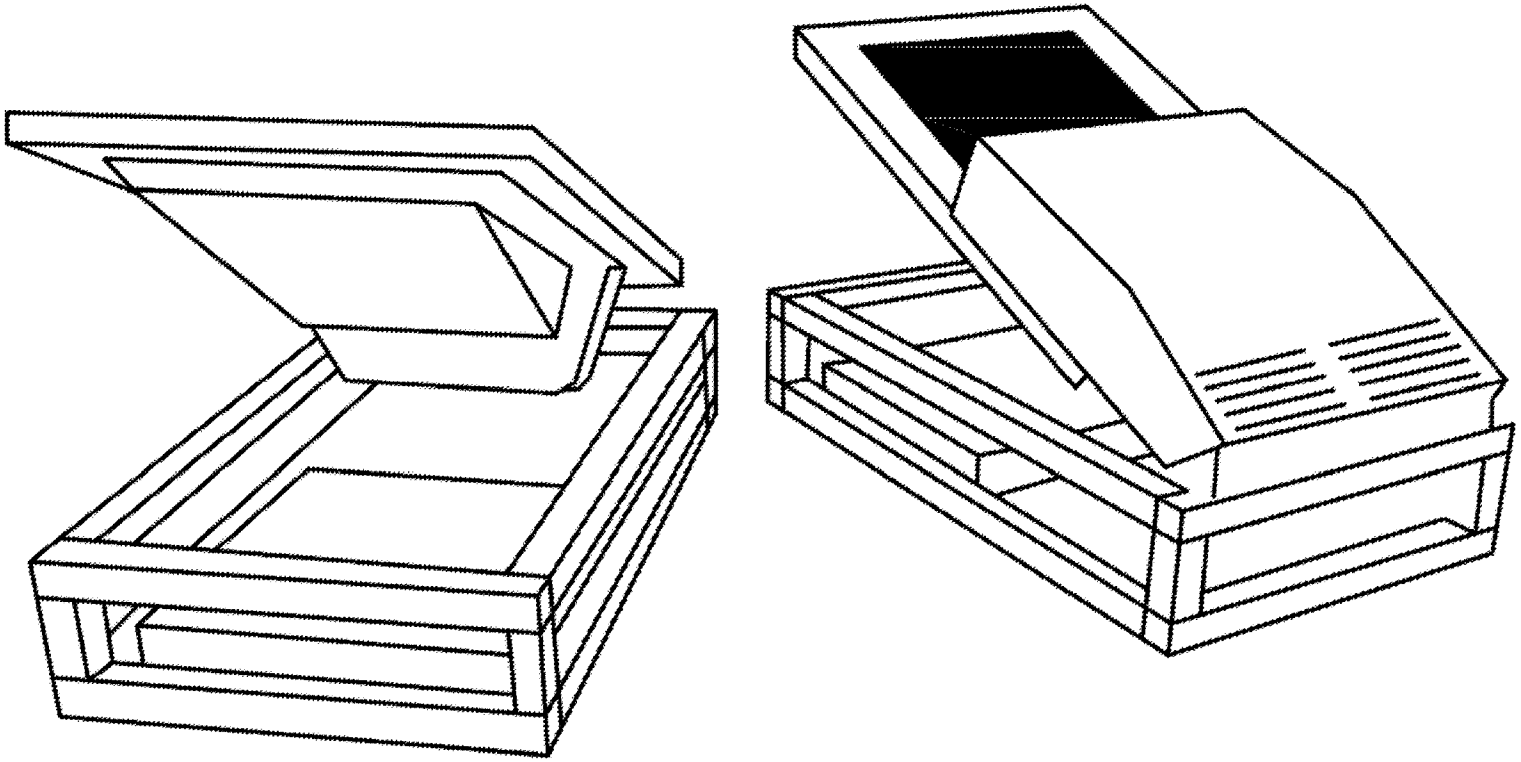
Figure 15:
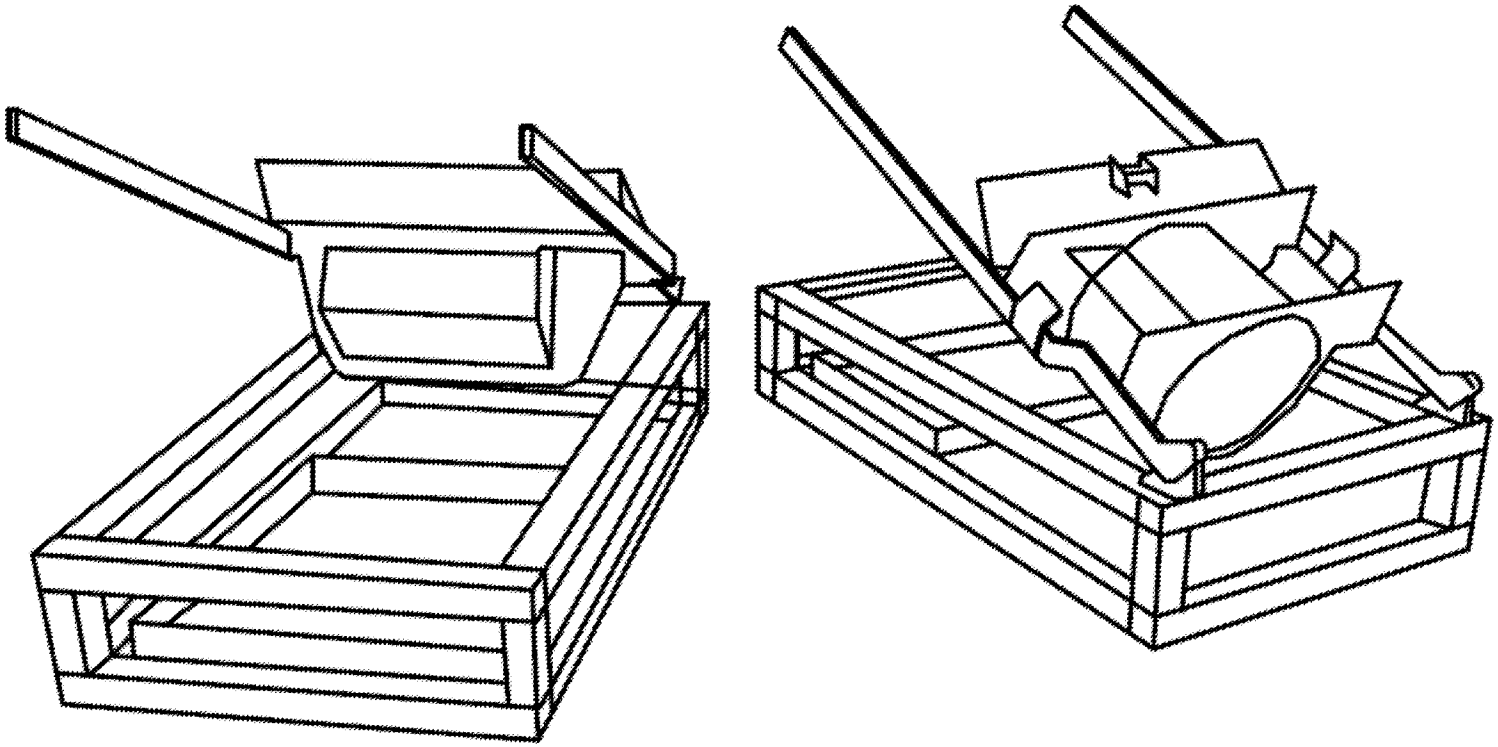

FIG. 6 shows an open side view of the shoe dryer.

FIGS. 7-15 show isometric views of the shoe dryer as a 3D model, with the main elements added step by step going through the figures.

As shown in the figures, the shoe dryer comprises:

1—a hollow metallic body;
2—stiffeners, of square section;
3—axle supports;
4—holders, made in the form of bent metallic strips;
5—a fan;
6—a chip, placed on a plate;
7—a gap in the plate, where the fan is placed;
8—plates, to which the fan is attached;
9—a spiral-shaped heater;
10—an airflow nozzle;
11—a motion sensor;
12—a latticed plate for shoes;
13—a meltwater discharge body;
14—a tray for meltwater collection;
15—an air trap;
16—a front cover.

The shoe dryer thus comprises a hollow metallic body 1 provided with at least two axle supports 3 of triangular shape in the upper portion, the supports being joined with at least two holders 4 by swivels with a tilt angle of up to 110°, wherein the hollow metallic body 4 is of rectangular shape and is made of stiffeners 2, preferably of square section, aligned against each other, and holders 4 are made in the form of slightly bent metallic strips;

a fan 5 placed in a gap 7 between two plates 8 inside the hollow metallic body 1, wherein the fan 5 is equipped with a chip 6 placed on a plate in the upper portion of the fan 5;

a spiral-shaped heater 9 placed inside the hollow metallic body 1 immediately before the fan 5;

an airflow nozzle 10 attached to the plate 8 that holds the fan 5 and directed at a latticed plate 12 for shoes, wherein the airflow nozzle 10 is further equipped with a motion sensor 11 that is activated by the presence of shoes on the latticed plate 12;

a latticed plate 12 for shoes placed above a meltwater discharge body 13;

a meltwater discharge body 13 placed on the holders 4 in the upper portion of the metallic body 1, wherein the meltwater discharge body 13 is tilted towards the tray for meltwater collection 14;

a square-shaped tray for meltwater collection 14 placed under the meltwater discharge body 13 inside the hollow metallic body 1;

an air trap 14 placed in the butt end of the metallic body 1 between the two axle supports 3.

The shoe dryer is further provided with a front cover 16.

Below is the description of the preferred embodiments of the invention. This example is provided to illustrate the feasibility of the claimed technical solution using the present set of features, rather than to limit the invention.

Example

A person wearing shoes steps on the latticed plate, triggering the motion sensor which is activated by the presence of shoes on the plate. Then, hot air is blown on the outer surface of the shoes through the airflow nozzle, and on the soles through the holes in the plate. Meltwater drips into the tray for meltwater accumulation through the meltwater discharge body.

The present invention helps to keep the buildings clean, thus saving water by reducing the cleaning required, as well as to improve safety of walking on marble and tiled floors by drying shoes and removing water and icing from their soles.

Having thus described a preferred embodiment, it should be apparent to those skilled in the art that certain advantages of the described method and apparatus have been achieved.

It should also be appreciated that various modifications, adaptations, and alternative embodiments thereof may be made within the scope and spirit of the present invention. The invention is further defined by the following claims.

What is claimed is:

1. A shoe dryer comprising:

a working surface for drying shoes;

the working surface including a plurality of holes in communication with air venting means;

a hollow plastic case with hemispherical recesses provided for placing shoes while stepping onto the working surface;

the recesses formed as latticed platforms, wherein hot or warm air is vented from a bottom of the dryer onto soles of the shoes through the lattice cells, and wherein horizontal slits are provided over an entire bottom part of the hemispherical recesses for venting warm air onto outer surface of the shoes, and a tray for collecting water located under the latticed platforms in the entire bottom part of the dryer, wherein the water is discharged either into a sewer system or outside, and the dryer further comprising:

means for heating the air vented from the outside;

means of pumping the heated air into the hollow plastic case; and motion sensors for detect shoes on the platform.

2. A shoe dryer comprising:

a working surface for drying shoes, the working surface having a plurality of holes in communication with air venting means;

a hollow metallic body with at least two axle supports in an upper portion of the hollow metallic body, the at least two axle supports being joined with at least two holders by swivels;

a fan placed in a gap between two plates that hold the fan inside the hollow metallic body;

a heater placed inside the hollow metallic body immediately before the fan;

an airflow nozzle attached to the plate that holds the fan and directed at a latticed plate for shoes;

wherein the latticed plate is above a meltwater discharge body that is placed on the holders in the upper portion of the hollow metallic body;

a tray for meltwater collection placed under the meltwater discharge body inside the hollow metallic body;

an air trap placed in a butt end of the hollow metallic body between the two axle supports.

3. The device of claim 2, wherein the hollow metallic body has a rectangular shape.

4. The device of claim 2, wherein the hollow metallic body is made of stiffeners with a square cross-section, that are aligned against each other.

5. The device of claim 2, wherein the axle supports have a triangular shape.

6. The device of claim 2, wherein the axle supports are joined with the at least two holders by swivels with a tilt angle of up to 110°.

7. The device of claim 2, wherein the at least two holders are slightly bent metallic strips.

8. The device of claim 2, wherein the fan is equipped with a chip placed on a plate in the upper portion of the fan.

9. The device of claim 2, wherein the heater is shaped as a spiral.

10. The device of claim 2, wherein the airflow nozzle includes a motion sensor that is activated by a presence of shoes on the latticed plate.

11. The device of claim 2, wherein the meltwater discharge body is angled downward towards the tray for meltwater collection.

12. The device of claim 2, wherein the tray for meltwater collection has a square shape.

13. The device of claim 2, wherein the air trap is between the two axle supports.

14. The device of claim 2, further comprising a front panel covering the device.

* * * * *